US006103057A

United States Patent [19]

Fagerlund

[11] Patent Number: 6,103,057

[45] **Date of Patent: *Aug. 15, 2000**

[54] KRAFT DIGESTING PROCESS WHEREIN A VAPOR INTERFACE IS FORMED BY WITHDRAWING HOT COOKING LIQUOR

[76] Inventor: Bertil K. Fagerlund, 65 Northgate Dr., Ponte Vedra, Fla. 32082

[ * ] Notice: This patent issued on a continued prosecution application filed under 37 CFR 1.53(d), and is subject to the twenty year patent term provisions of 35 U.S.C. 154(a)(2).

[21] Appl. No.: 08/872,818

[22] Filed: Jun. 11, 1997

[51] Int. Cl.[7] ..... D21C 3/00; D21C 11/06

[52] U.S. Cl. ..... 162/15; 162/49; 162/52; 162/82

[58] Field of Search ..... 162/52, 49, 82, 162/238, 15, 37

[56] References Cited

U.S. PATENT DOCUMENTS

| | | | |
|---|---|---|---|
| 1,885,918 | 11/1932 | Kenety | 162/52 |
| 2,861,884 | 11/1958 | Bennett | 162/238 |
| 3,843,468 | 10/1974 | Laakso | 162/52 |
| 3,928,123 | 12/1975 | Marks | 162/238 |
| 4,274,911 | 6/1981 | Fagerlund | 162/15 |
| 4,578,149 | 3/1986 | Fagerlund | 162/39 |
| 4,601,787 | 7/1986 | Fagerlund . | |
| 4,849,052 | 7/1989 | Grant . | |
| 5,059,281 | 10/1991 | Andrews | 162/239 |
| 5,059,284 | 10/1991 | Fagerlund . | |
| 5,080,757 | 1/1992 | Fagerlund . | |
| 5,643,410 | 7/1997 | Hiljanen et al. | 162/37 |
| 5,882,477 | 3/1999 | Laakso et al. | 162/52 |

FOREIGN PATENT DOCUMENTS

| | | |
|---|---|---|
| 0 492 364 A1 | 12/1991 | European Pat. Off. . |
| 0 810 321 A1 | 4/1997 | European Pat. Off. . |

*Primary Examiner*—Steven Alvo
*Attorney, Agent, or Firm*—Hill & Simpson

[57] ABSTRACT

A method for use in a batch digesting process is provided which includes the removal of a portion of the hot cooking liquor from the digester prior to the cook creating a liquid-vapor interface in the digester followed by the removal or purging of the vapors disposed above the liquid-vapor interface and the reduction of the pressure in the digester to about the saturation pressure of the hot cooking liquor. The inclusion of these steps in the process helps to eliminate a coating on the pulp fibers which has been found to inhibit the bleachability and runability of the fibers. Accordingly, an apparatus and method for the batch digesting of pulp fibers is provided which provides pulp fibers having improved bleachability and runability characteristics.

1 Claim, 1 Drawing Sheet

KRAFT DIGESTING PROCESS WHEREIN A VAPOR INTERFACE IS FORMED BY WITHDRAWING HOT COOKING LIQUOR

BACKGROUND OF THE INVENTION

The present invention is directed generally to the digestion of cellulosic material such as wood chips in a batch-type process. More specifically, the present invention is directed toward an improved batch-type process for digesting cellulose which results in a kraft pulp having improved bleachability and runability qualities.

Batch processes for digesting wood chips are known. Specifically, in conventional batch processes, the digester is filled with wood chips and then charged with a digesting liquor which, in a kraft pulp producing process, includes a solution of sodium hydroxide and a sulfur compound. The digester is then sealed and the charge is heated with steam to a cooking temperature at which the charge is maintained for a period of time referred to as "the cook". At the conclusion of the cook, a blow valve in the digester is opened and the contents of the digester is discharged into a blow tank by virtue of the hot liquor in the digester flashing into steam and forcing the delignified pulp out of the digester.

The above-described process is energy inefficient because much of the heat energy acquired by the wood chips and the digesting liquor during the process is lost through the blow tank and exhaust vapors. To recover this lost heat energy, attempts have been made to pass the vapors through various forms of heat recovery systems. However, the heat recovery systems were proven to be relatively inefficient and, instead, many pulp manufacturers attempted to install continuous digestion processes. The continuous digestion processes however are not preferred because of the high cost of the equipment needed for such a process when compared to the cost of the equipment needed for batch type processes.

One solution to the lost heat energy of batch type processes was provided in the form of a displacement heating process disclosed in U.S. Pat. Nos. 4,578,149 and 4,601,787. These patents disclose modified batch processes wherein, at the end of the cook, the digester is held under pressure, a displacement liquid is used to displace the hot cooking liquor under pressure and substantially at the cooking temperature. The displacement fluid may be recycled filtrate from the washing process. The pulp is then removed from the digester with the filtrate.

For the subsequent batch, the digester is again charged with wood chips. The chips are then preheated with the warm and hot liquors that were used in the previous batches. One accumulator is used for each displacement liquor. Accordingly, three accumulators may be used to store the displaced cool, warm and hot liquors, all of which may be used in the pre-treatment of the wood chips. As a result, most of the heat energy in the spent or partially spent liquors is utilized. All of the liquor fills in the digester are done by displacement. In previously known displacement techniques, i.e. the displacing fluid is pumped into the bottom of the digester and the displaced fluid flows out of the top of the digester.

U.S. Pat. Nos. 5,059,284 and 5,080,757 disclose yet further improvements to the above-described batch processes wherein, after the cook, the black liquor (or the spent liquor) is removed and transferred to a black liquor reservoir under pressure by pumping in a lower temperature displacement liquid in both the bottom and top ends of the digester. The black or spent high temperature liquor is removed at a mid-portion of the digester. In other words, the hot black liquor is pushed out through a mid-portion of the digester due to the simultaneous pumping of cool displacement liquid into both the top and bottom of the digester. As a result, the total time required for displacement is reduced. Further, intermixing of the displacement fluid and the hot black liquor is reduced since the distance along which the hot black liquor/displacement fluid travels is reduced by approximately one half. In other words, instead of the hot black liquor/displacement fluid interface traveling the entire length of the digester, the interface travels only one half of the length of the digester, i.e. from the top of the digester to the middle of the digester or from the bottom of the digester to the middle of the digester. Further, using the improved displacement techniques disclosed in U.S. Pat. Nos. 5,059,284 and 5,080,757 permits the operator to quickly terminate the cook and avoid overcooking the wood chips while, at the same time, reducing the overall cycle time.

In the manufacture of kraft pulp using the processes disclosed in U.S. Pat. Nos. 4,578,149, 4,601,787, 5,080,757 and 5,059,284, it has been found that some pulps, including kraft pulps, may be difficult to bleach to full brightness with a moderate consumption of bleaching chemicals than other pulps. Further, the kraft pulps may be more difficult to process in other process steps, such as pumping the pulp out of the digester after completion of the cooking, screening and washing of the pulp because the pulp exhibits hydrophobic qualities.

Analyses of the kraft pulp fibers indicate that the fiber surfaces are covered with a coating of a material deposited from wood extractives. Little is known about the composition of this coating. The coating is particularly problematic if the specie of wood used as a source of the wood chips is rich in nonsoponifiable extractives. While extensive studies have been performed to obtain an understanding of the nature of the coating on the kraft pulp fibers and to find a solution of how to avoid this coating, no significant advances in addressing this problem have been provided.

Accordingly, there is a need for an improved batch process for producing kraft pulp which provides a way to produce kraft pulp fibers using the energy saving techniques provided by the processes discussed above but which also produces a kraft pulp fiber that is free or substantially free of the problematic coating. Such a process would provide an energy efficient means for producing kraft pulp fibers which have improved bleachability and runability characteristics.

SUMMARY OF THE INVENTION

The aforenoted needs are satisfied by the present invention which provides a batch process for producing a column of delignified pulp and hot spent liquor by cooking a charge of cellulosic material and cooking liquor in a digester. The process of the present invention includes the steps of filling the digester to capacity with a mass of cellulosic material and cooking liquor followed by the step of removing a portion of the cooking liquor from the digester thereby creating a liquid vapor interface. The process includes the further step of heating the cellulosic material and cooking liquor to a cooking temperature. At this point, the pressure inside the digester is greater than the saturation pressure of the cooking liquor. The process further includes the step of reducing the pressure in the digester to at or near the saturation pressure of the cooking liquor by withdrawing vapor from the digester. Vapor may also be withdrawn during the heating step.

In an embodiment, after a portion of the cooking liquor has been withdrawn, the temperature of the digester is increased to a level exceeding the preferred cooking temperature prior to the withdrawal of vapor from the digester.

In an embodiment, the vapor is transmitted directly to a turpentine recovery system as opposed to one of the accumulators which eliminates the possibility of the extractives from precipitating or condensing back into the liquors.

Removal of the vapor from the top of the digester after removal of a portion of the cooking liquor alleviates the problem of the coating of the pulp fibers discussed above because it has been found that the components of this coating have a lower vapor pressure which enables a large portion of the components to be withdrawn with the vapor if the pressure reduction in the digester is substantial, i.e., the pressure in the digester is reduced to below the cooking pressure and at least towards the saturation pressure of the cooking liquor or a level close to the saturation pressure of the cooking liquor.

Specifically, the vapor phase created by withdrawal of a portion of the cooking liquor from the digester includes partial pressures of water vapor, turpentine and other extractives. It has been found that in accordance with the present invention these extractives contribute to the formation of the problematic coating on the pulp fibers. Further, it has been found in accordance with the present invention, that the bulk portion of the extractives constitutes diturpenes which have a lower vapor pressure than turpentine components and water at the typical cooking temperature ranges (approximately 155–175° C.). Accordingly, the diturpene extractives which contribute to the problematic coating are substantially withdrawn when the vapor is drawn off the top of the digester after removal of a portion of the cooking liquor. Because of the low vapor pressure of the extractives, the vapor is preferably sent directly to a turpentine recovery system as opposed to one of the accumulators so that extractives will not condense or reprecipitate back into the liquors.

In an embodiment, after a portion of the cooking liquor is removed from the digester, the pressure in the digester is reduced to a pressure between the pressure in the digester at the cooking temperature and the saturation pressure of the cooking liquor at the current temperature.

In an embodiment, after a portion of the cooking liquor is removed from the digester, the pressure is reduced to the saturation pressure of the cooking liquor at the cooking temperature.

In an embodiment, after a portion of the cooking liquor is removed from the digester, the pressure is reduced to the saturation pressure of the cooking liquor at the cooking temperature as compensated for the presence of inorganic and organic materials in the cooking liquor.

In an embodiment, the process includes the additional steps of measuring the pressure inside the digester, calculating the saturation pressure of the cooking liquor at the cooking temperature as compensated for the presence of the inorganic and organic materials and determining the difference between the measured pressure and the calculated saturation pressure.

In an embodiment, the process further includes the preliminary steps of placing cellulosic material in the digester, filling the digester to capacity with a low temperature liquor to heat the cellulosic material, pumping high temperature liquor into the digester thereby displacing the low temperature liquor out the digester and refilling the digester to capacity, followed by pumping a mixture of hot white and hot black liquor into the digester, thereby displacing at least some of the high temperature liquor out the top of the digester and refilling the digester to capacity with a mixture of high temperature liquor and hot white liquor to be used as the cooking liquor. In an embodiment, the calculation of the saturation pressure of the cooking liquor at the elevated cooking temperature must be compensated for the presence of the inorganic and organic material in the cooking liquors. Specifically, the presence of the solid cellulosic material in the digesting liquor will typically increase the boiling point of the liquor at the digester pressure by 2–3° C.

In an embodiment, the portion of the cooking liquor that is withdrawn from the digester comprises from 15% or from about 1% to about 10% of the digester volume.

In an embodiment, the vapor that is drawn off the top of the digester after a portion of the hot cooking liquor has been removed is transmitted directly to a turpentine recovery system. The transmission of the vapors directly to the turpentine recovery system is more efficient than transmitting the vapors to a pressurized vessel in the tank farm.

It is therefore an advantage of the present invention to provide an improvement to currently available batch digesting processes which results in a pulp, such as a kraft pulp, having improved bleachability and runability.

Another advantage of the present invention is that it may be implemented in existing equipment for carrying out batch digesting processes.

Another advantage of the present invention is that it provides an improved batch process for manufacturing pulps.

These and other objects and advantages of the present invention will become more fully apparent as the following description is read in conjunction with the accompanying drawing and appended claims.

BRIEF DESCRIPTION OF THE DRAWING

The present invention is illustrated more or less diagrammatically in the accompanying drawing wherein.

Figure 1:
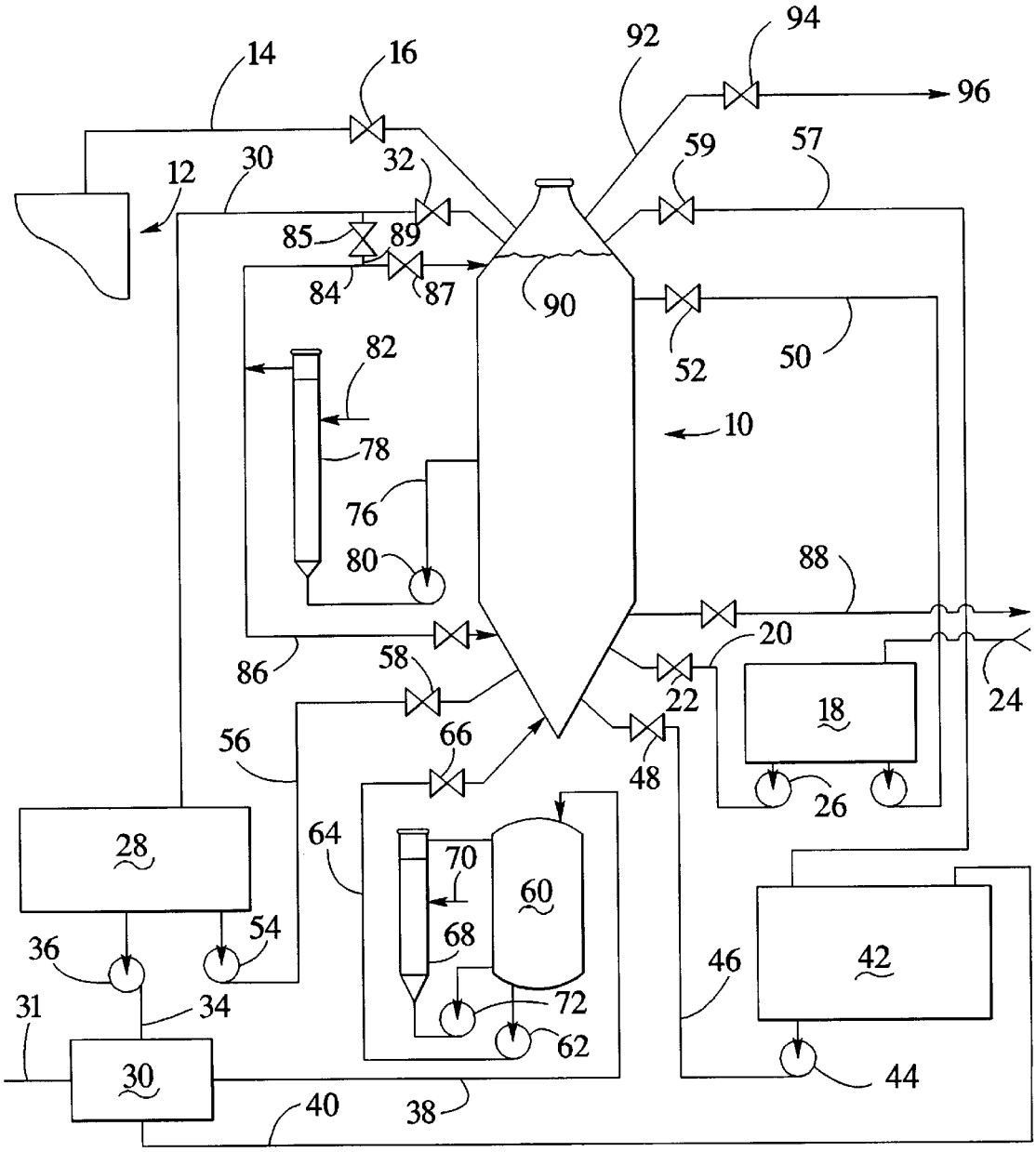
FIG. 1 is a schematic view illustrating, in simplified form, a digester and equipment associated with the digester which may be utilized in carrying out an embodiment of the present invention.

It should be understood that the drawing is not necessarily to scale and that in certain instances, details which are not necessary for an understanding of the drawing have been eliminated. It should also be understood that the present invention is not limited by the particular embodiment illustrated in the drawing.

DETAILED DESCRIPTION OF THE PRESENTLY PREFERRED EMBODIMENTS

As indicated above, it is convention, in the chemical digestion of wood pulp, to charge a digester with cellulosic material, i.e. wood chips, and then introduce into the digester a reactive liquor including a reactive chemical. In the case of a kraft process, the reactive liquor, known as cooking liquor or white liquor, is essentially an aqueous solution which includes a sulfur compound. The method of the present invention may also be used in a soda process, i.e. without sulfur. Digestion occurs with the contents of the digester at an elevated cooking temperature and pressure, the temperature within the digester typically being within the range of 330° to 350° F. (165° to 177° C.). At the conclusion of the cooking cycle, the reactive liquor is referred to as black liquor or spent liquor, which is at the digester temperature and still contains residual active chemicals.

At the conclusion of the cooking cycle, and while maintaining the pressure in the digester, a displacement liquid is pumped into the bottom of the digester as illustrated in U.S. Pat. No. 4,578,149. In the alternative, the displacement fluid may be simultaneously pumped into the top and bottom of the digester as illustrated in U.S. Pat. Nos. 5,080,757 and 5,059,284. As the displacement fluid fills the digester, it progressively expels and replaces the hot spent liquor or black liquor produced by the cook. The hot black liquor leaves the digester at essentially the temperature of the digester at the conclusion of the cook and may be accumulated in a high temperature, black liquor accumulator.

One suitable displacement fluid is the filtrate obtained from washing the pulp or delignified fibers obtained in an earlier digestion of the wood chips. Such a filtrate has a temperature elevated from the usual ambient temperature (by reason of passing through the warm fibers), and in practicing the invention, such filtrate may be expected to have a temperature within the range of 60° to 90° C. The filtrate is then removed with the delignified pulp.

In a three-stage displacement heating process, a first fill will be performed using low temperature liquor from a low temperature accumulator. The low temperature liquor is displaced from the digester using an intermediate temperature liquor from an intermediate temperature accumulator with a following displacement with a high temperature liquor from a high temperature accumulator. Finally, the high temperature liquor is at least partially displaced with a mixture of hot white liquor and hot black liquor to provide a mixture referred to as the cooking liquor before the cook is begun. White liquor may be added to the low, intermediate and high temperature liquors throughout the displacement process.

In previous batch processing systems for the production of kraft pulp, the digester remains filled throughout the cook. However, as set forth above, kraft pulp produced using this method may include a coating on the individual fibers which adversely effects the bleachability and runability of the pulp. In accordance with the present invention, prior to the final heating of the digester, a portion of the hot cooking liquor is drawn out of the digester to create a vapor-liquid interface within the digester and the digester is heated to the cooking temperature.

At this point, the digester is still pressurized and is normally at a pressure that is greater than the saturation pressure of the hot cooking liquor. In some cases, the vapor is continually drawn off which would reduce the pressure in the digester. The vapor that has accumulated above the liquid-vapor interface is drawn off and transmitted directly to a turpentine recovery system. It has been found that this vapor that is initially formed after the drawing off of a portion of the hot cooking liquor contains the elements that are attributable to the problematic coating found on kraft pulp fibers and that the components that constitute this coating have a lower partial pressure at typical cooking temperatures than both turpentine constituents and water. Accordingly, removal of the vapor to the turpentine recovery system as opposed to an accumulator will prevent the problematic extractives from condensing back into the displacement and/or cooking liquors.

Therefore, by purging the vapor above the liquid vapor interface, the components that contribute to the coating found on kraft pulps are removed and the prevention of the coating is substantially achieved.

An apparatus for carrying out the method of the present invention is illustrated in FIG. 1. Specifically, a digester 10 is shown which is of a type typically used in the chemical digestion of wood chips. The digester 10 would also include a removable cover (not shown) for the purpose of charging the digester with wood chips. The digester 10 is connected to a spent or black liquor storage known as a cool tank 12 by way of a conduit 14 and valve 16. In the making of pulp, spent black or cooking liquor is recovered in the storage 12 and converted, using conventional procedures, into white liquor which provides the active chemical required in the digestion of wood chips. Details of this procedure are eliminated from this disclosure as they are unnecessary to an understanding of the present invention.

After the cook, the hot black or spent liquor is displaced from the digester 10 by washer filtrate supplied from a washer filtrate storage 18. Filtrate is pumped from the storage 18 through the conduit 20 and valve 22 into the bottom of the digester 10. The washer filtrate storage 18 is replenished through the supply conduit 24. A pump 26 is utilized to provide the necessary pressure to overcome the hydrostatic head of the spent black liquor in the digester 10. The hot spent liquor, upon being expelled from the digester 10 by the washer filtrate, is collected in a high temperature accumulator 28 by way of the conduit 30 and valve 32.

A portion of the liquor in the high temperature accumulator 28 may be used to preliminarily heat the white liquor used for the cook. Thus, a heat exchanger 30 is provided through which a conduit 31 supplies white liquor for the cook. Hot spent liquor from the high temperature accumulator 28 is pumped through the heat exchanger 30 by way of the conduit 34 and pump 36. After transmitting much of its heat to the white liquor traveling from the conduit 31, through the heat exchanger 30 and to the conduit 38, the now-cooled black liquor proceeds through the conduit 40 into the intermediate temperature accumulator 42. The cooled liquor in the intermediate temperature accumulator 42 is of a lower temperature than the hot spent liquor accumulated in the high temperature accumulator 28 but still is of a sufficient temperature to heat the wood chips. Accordingly, after the digester 10 has been filled with wood chips, the fluid in the intermediate temperature accumulator 42 is pumped into the bottom of the digester 10 by way of the pump 44, conduit 46 and valve 48.

After the intermediate temperature liquor from the accumulator 42 has filled the digester 10, the intermediate temperature liquor is displaced by fluid from the high temperature accumulator 28. Fluid from the high temperature accumulator 28 is pumped into the bottom of the digester by the pump 54, through the conduit 56 and valve 58. As hot liquor is injected into the bottom of the digester 10 through the conduit 56, the intermediate temperature liquor is pumped out the top of the digester 10 through the valve 59 and conduit 57 back into the intermediate temperature accumulator 42.

In the third displacement, a portion of the liquor from the high temperature accumulator 28 is displaced with a mixture of hot white liquor and hot black liquor to create a cooking liquor. Hot white liquor from the hot white liquor storage 60 is pumped from the storage 60 by the pump 62 through the conduit 64 and the valve 66. The hot white liquor in the storage 60 may also be heated by way of a heat exchanger 68, which may be a steam operated heat exchanger to which steam may be supplied through an input line 70. A circulation pump 72 is used to circulate hot white liquor through the exchanger 68. As the hot white liquor is pumped into the bottom of the digester through the conduit 64, a portion of the hot black liquor is returned to the high temperature accumulator 28 through the conduit 30 and valve 32.

At this point, the digester 10 is charged to capacity with cooking liquor (i.e. a mixture of hot black and hot white liquors) and wood chips. The temperature in the digester 10 may be increased by pumping fluid through the conduit 76 and through the heat exchanger 78 by way of the pump 80. Steam may be supplied to the exchanger 78 through an input line 82. Liquor may be returned to the top and bottom of the digester through the top conduit 84 and bottom conduit 86 respectively. The line 88 is a blow off line used for clearing the pulp fibers from the digester at the end of the cook. The top and bottom displacement techniques disclosed in U.S. Pat. Nos. 5,059,284 and 5,080,757 may also be utilized.

In accordance with the present invention, a portion of the cooking liquor is drawn out of the digester 10. The cooking liquor may be drawn through the conduit 76 to the suction side of the pump 80 and pumped through the conduit 84, through the conduit 89 and valve 85 and through the conduit 30 into the accumulator 28. The valves 87 and 58 are closed during the liquor withdrawal; the valve 32 may remain open during part of the liquor withdrawal to provide back pressure. The specific means for removing a portion of the cooking liquor from the charged digester is not critical; the cooking liquor may be drawn from other conduits connected to the digester 10 in addition to the conduit 76.

The cooking liquor may also be withdrawn with vapor through the line 92 and valve 94. The liquid/vapor mixture would need to be sent to a collection vessel (not shown) where the liquid is separated from vapor. The vapor would then be sent to the turpentine recovery system and the liquid could be returned to one of the accumulators.

The amount of cooking liquor withdrawn can vary. It has been found that the removal of 30 tons of cooking liquor from a 325 $m^3$ digester provides a sufficient amount of volume for the accumulation of vapors above the liquid vapor interface. However, the amount of cooking liquor withdrawn may range from less than 5% of the total digester volume to more than 15% of the digester volume, depending upon the amount and density of the solids contained within the digester 10 as well as the wood specie.

After the cooking liquor is withdrawn and the system has been returned to an equilibrium state, vapor will accumulate in the top of the digester 10 above the liquid-vapor interface indicated at 90. As noted above, it has been found by the inventor that much of this vapor contains the components that ultimately form the problematic coating on kraft pulp fibers because the components that form the problematic coating have a lower partial pressure than both turpentine and water at the typical cooking temperatures for kraft pulp. Accordingly, removal of the vapor through the line 92 and valve 94 results in removal of much of the components that form this coating. In a preferred embodiment, the vapor is transmitted directly to a turpentine recovery system indicated only generally at 96 as opposed to an intermediate pressure vessel in the tank farm.

By removing vapors through the line 92, the total pressure in the digester 10 is reduced. In an embodiment of the present invention, the pressure in the digester 10 is reduced to the saturation pressure of the cooking liquor at the temperature of the digester 10. Preferably, in determining the saturation pressure of the cooking liquor, a compensation should be made for the presence of inorganic and organic material in the cooking liquor which will typically increase the boiling point of the hot white liquor by 2 or 3°. Further, it may not be necessary to reduce the pressure to the saturation pressure of the cooking liquor to achieve some benefits. A substantial and aggressive reduction of the pressure in the digester 10 by the drawing off of vapor will prove to be most beneficial because of the relatively low vapor pressure of the components that contribute to the problematic coating on the kraft pulp fibers in the vapor phase. To enhance the removal of the problematic extractive components with the vapor phase, it may be beneficial to increase the temperature of the digester 10 to a temperature that exceeds the preferred cooking temperature. An increased temperature in the digester 10 will increase the partial pressures of the problematic components in the vapor phase.

After the vapor is drawn off and the pressure of the digester 10 has been reduced, the remaining charge in the digester 10 is then cooked using principles discussed herein and in U.S. Pat. Nos. 4,578,149, 4,601,787, 5,080,757 and 5,059,284.

Accordingly, the present invention provides an improved and rapidly operating process which is capable of producing pulp fibers with improved bleachability and runability due to a reduction or elimination of a problematic coating on the fibers. Further, the process may be implemented in existing equipment with only minor modifications.

Although only a limited number of embodiments of the present invention have been illustrated and described, it will at once be apparent to those skilled in the art that variations may be made within the spirit and scope of the present invention. Accordingly, it is intended that the scope of the present invention be limited solely by the scope of the hereafter appended claims and not by any specific wording in the foregoing description.

What is claimed is:

1. A batch digesting process for producing kraft pulp resulting in improved bleachability and runability of the kraft pulp, the process comprising:

placing a mass of cellulosic material in a digester, filling the digester to capacity with a low temperature liquor to heat the cellulosic material, pumping high temperature liquor into the digester thereby displacing the low temperature liquor out of the digester and refilling the digester to capacity, pumping a combination of hot white liquor and a hot black liquor into the digester thereby displacing at least a portion of the high temperature liquor out of the digester and providing a hot cooking liquor and refilling the digester to capacity, removing from about 1% to about 15% of the volume of the hot cooking liquor from the digester thereby creating a liquid vapor interface in the digester, heating the remaining cellulosic material and hot cooking liquor charge resulting in a superatmospheric pressure inside thee digester which is greater than the saturation pressure of the hot cooking liquor and after the superatmospheric pressure is reached in the digester, reducing the pressure in the digester to about the saturation pressure of the hot cooking liquor as compensated for the presence of organic and inorganic material in the hot cooking liquor by withdrawing vapor from the digester, transmitting the withdrawn vapor directly to a turpentine recovery system after withdrawing the vapor from the digester, and heating the material in the digester and cooking the remaining cellulosic material in the digester.

* * * * *